US009346655B2

(12) United States Patent
Von Lutterotti et al.

(10) Patent No.: US 9,346,655 B2
(45) Date of Patent: May 24, 2016

(54) GRIPPING MECHANISM FOR A LIFTING DEVICE AND METHOD FOR USING THE GRIPPING MECHANISM

(71) Applicant: ARS MECCANICA DOLOMITI GMBH/SRL, Bolzano (IT)

(72) Inventors: Heinrich Von Lutterotti, Bozen (IT); Aldo Christè, Eppan (IT)

(73) Assignee: ARS MECCANICA DOLOMITI GMBH/SRL, Bolzano (IT)

( * ) Notice: Subject to any disclaimer, the term of this patent is extended or adjusted under 35 U.S.C. 154(b) by 0 days.

(21) Appl. No.: 14/513,958

(22) Filed: Oct. 14, 2014

(65) Prior Publication Data

US 2015/0030427 A1 Jan. 29, 2015

Related U.S. Application Data

(63) Continuation of application No. PCT/EP2013/058016, filed on Apr. 17, 2013.

(51) Int. Cl.

| | |
|---|---|
| ***B66C 1/00*** | (2006.01) |
| ***B66C 1/12*** | (2006.01) |
| ***B66C 1/16*** | (2006.01) |
| ***B66C 1/18*** | (2006.01) |

(52) U.S. Cl.

CPC . *B66C 1/12* (2013.01); *B66C 1/125* (2013.01); *B66C 1/16* (2013.01); *B66C 1/18* (2013.01)

(58) Field of Classification Search

CPC ..... B66C 1/12; B66C 1/125; B66C 1/16; B66C 1/18; B66C 1/663; B66C 1/422; B66C 19/002; B66C 13/00; B66F 9/18

See application file for complete search history.

(56) References Cited

U.S. PATENT DOCUMENTS

| | | | | |
|---|---|---|---|---|
| 1,756,057 | A | 4/1930 | Doty et al. | |
| 3,042,227 | A * | 7/1962 | Tantlinger | B63B 27/12 114/72 |
| 3,151,904 | A * | 10/1964 | Tantlinger | B66C 1/101 294/81.41 |
| 3,606,056 | A | 9/1971 | Morgan | |
| 4,667,834 | A * | 5/1987 | Lanigan | B60L 11/08 212/288 |
| 6,138,846 | A * | 10/2000 | Baumann | B66C 1/663 212/326 |
| 7,374,405 | B2 | 5/2008 | Wobben | |
| 2003/0168871 | A1 * | 9/2003 | Geis | B66C 1/663 294/81.21 |
| 2009/0025219 | A1 | 1/2009 | Hansen et al. | |

FOREIGN PATENT DOCUMENTS

| | | | |
|---|---|---|---|
| EP | 1925583 | B1 | 4/2010 |
| WO | 03104645 | A1 | 12/2003 |

* cited by examiner

*Primary Examiner* — Stephen Vu
(74) *Attorney, Agent, or Firm* — Slater Matsil, LLP

(57) ABSTRACT

A method for using a gripping mechanism and a gripping mechanism for lifting devices is disclosed. In an embodiment a gripping mechanism includes a frame comprising parallel longitudinal members and cross members, a connecting device supported by the frame, the connecting device configured to receive a lifting gear and carriages connected to the longitudinal members, the carriages configured to be adjustable along the longitudinal members, wherein the carriages are adjustable by a drive. The gripping mechanism further includes rewinding devices located at the carriages and continuous flexible elements configured to receive a product to be transported, wherein ends of the continuous flexible elements are connected to the rewind devices, and wherein the rewinding devices are configured to lengthen or shorten the continuous flexible elements.

20 Claims, 8 Drawing Sheets

GRIPPING MECHANISM FOR A LIFTING DEVICE AND METHOD FOR USING THE GRIPPING MECHANISM

This application is a continuation of International Application No. PCT/EP2013/058016, filed on Apr. 17, 2013, which claims priority to Italian Patent Application No. BZ2012A000013, filed on Apr. 18, 2012, both of which are hereby incorporated by reference in their entireties.

TECHNICAL FIELD

The present invention relates to a gripping mechanism for lifting device and a method for using the gripping mechanism.

BACKGROUND

Known lifting devices include a hook or U-shaped straps looped or laced around the product to be transported. The straps can be tightened or fastened. The length of the belt is fixed and the products to be transported are often not easily balanced thereby risking that one or more of these products detaches and falls to the ground. However, if the belt is moved, the integrity of the transported product is at risk. Accordingly, conventional gripper elements are not able to position the product or to ensure the integrity of the product and yet to avoid any risk to the integrity of the operating personnel.

Known methods to align and accurately position cargo during a lifting procedure require always additional manpower constantly repositioning the straps. Accordingly, these individuals are exposed to a big security risk, since they always stay within the immediate area of the lifting device. If the uplifted cargo starts swinging thereby creating forces which cannot be controlled by man power the surrounding workers are at great risk.

European Patent No. EP 1 925 583 B 1 describes a gripping mechanism where straps are unwound from a frame in order to wrap it around an object to be grasped and to make the object transportable. The spacing between the straps cannot be adjusted.

SUMMARY

Embodiments of the invention provide a gripping mechanism comprising a frame supporting a gripping tool for receiving products or loads to be conveyed.

In embodiments the gripping mechanism comprising a support having at least two mutually parallel longitudinal members and at least two cross members, a gripping tool carried by the support, the gripping tool configured to carry a products to be conveyed, a connecting device and a hoist, wherein the gripping tool comprises at least one cross bar, at least one rewind device and at least one continuous, flexible element having ends being spaced apart, wherein the continuous, flexible element can be lengthened and shortened, wherein the at least one rewind device attached to the at least one cross bar is adjustable along the longitudinal member and can be actuated by a drive.

Embodiments of the invention have the advantage that the gripping mechanism can grip one or more products to be transported at the same time and with a uniformly distributed force. A further advantage is that the products can be transported to a desired location with straps, high precision and accuracy.

Further embodiments include a gripping mechanism comprising a frame supporting a gripping tool for holding products to be conveyed, and comprises a connecting device between the frame and the lifting gear, the gripping instrument may be formed by at least one continuous flexible loop like element, wherein the ends of the continuous flexible member is suspended at the rewind device, and wherein the continuous flexible element is expansible and contractible by the rewind device. To distribute the gripping force evenly, two rewind devices for corresponding support are provided. The rewind devices are arranged on a carrier preferably a carriage, the carrier being adjustable along the rails of the frame. For example, the adjustment can be performed by a spindle, which acts on the carriage by a screw coupling and by a drive located on the free end of the spindle. The spindle may also be adjusted at one of the cross members. In some embodiment, two carriages are provided each with two rewind devices, wherein each of the rewind devices can wind or recoil an end of a continuous flexible element.

In various embodiments the continuous flexible element is a belt, a strap, or a chain, etc.

In various embodiments, the connecting device between the gripping mechanism and the lifting gear or hoist is a rotary plate having a rotation axis that is perpendicular to the frame plane. In various embodiments, the rotation plate can be driven and rotated around the axis by a motor. In further embodiments the frame can tilt relative to the lifting gear. The worm rotation plate is advantageously a self-locking system.

The here described techno lifting gear comprises adjustable straps being made of polyester, polyamide, polypropylene or textile slings.

The engine operates with oil pressure or electric energy.

A vertical motion system may be arranged above the rotation plate to enable the positioning of the load in all positions including at a wall.

The techno lifting gear can be construed and designed according to customer needs accounting for length, width as well as for carrying capacity. The carrying capacity can be arbitrary.

The techno lifting gear is made of steel using the latest technology in terms of mechanics, electronics and oil dynamics. It comprises lifting members on the entire length and width in order to allow a balanced and secure lifting of the cargo. If belts made of polyester are used, delicate materials such as wood, stainless steel, etc. are not roughened or damaged.

The polyester belts can be selected in the various dimensions (width and length) according to the required load bearing capacity. It is also possible to replace the polyester belt with steel cables or generally with all kind of flexible members.

The techno lifting gear can be attached to and used by truck mounted cranes, construction cranes, material ropeways in forests for transporting tree trunks and other materials, mechanical travelling cranes in industrial structures (for example for lathe work, milling work, work on large toothed wheels or gearwheels, motor shafts, pistons for boat engines, etc.), on movable bridges and further lifting systems.

In order to lift and reposition prefabricated parts (for example, wood walls, etc.), beams, metal plates, columns, ceilings, hanging type fixtures, timers, floors, infills and all kind of covers carrier and reposition, the techno gear may not need the help of additional workers. Accordingly, maximum safety at work especially for workers in the close proximity of the cargo is maintained.

The techno lifting gear can be used for logistics in magazines (for example, steel mills), to lift steel blocks, strands, coils of wires, sheets, pipe sections, profiles, mechanical pipes. Further, the techno lifting gear can lay pipes (for example, gas, water, oil). The ability to rotate and position the cargo simplifies the logistics, because the cargo may not be detached and thereafter fixed twice. The techno lifting gear provides the ability to lift or lower cargo in basements or to transport cargo through trap doors in different depths. The cargo may always be safely moved with balanced weight. The raised cargo is positioned at the techno lift, forming a compact load with reduced dimensions in order to move through tight spaces. For example, the cargo can be moved through a skylight, through a window, through a door, and through small openings etc.

BRIEF DESCRIPTION OF THE DRAWINGS

Further features and details will become apparent from the claims and from the following description of a preferred embodiment illustrated in the accompanying drawing.

Figure 1:
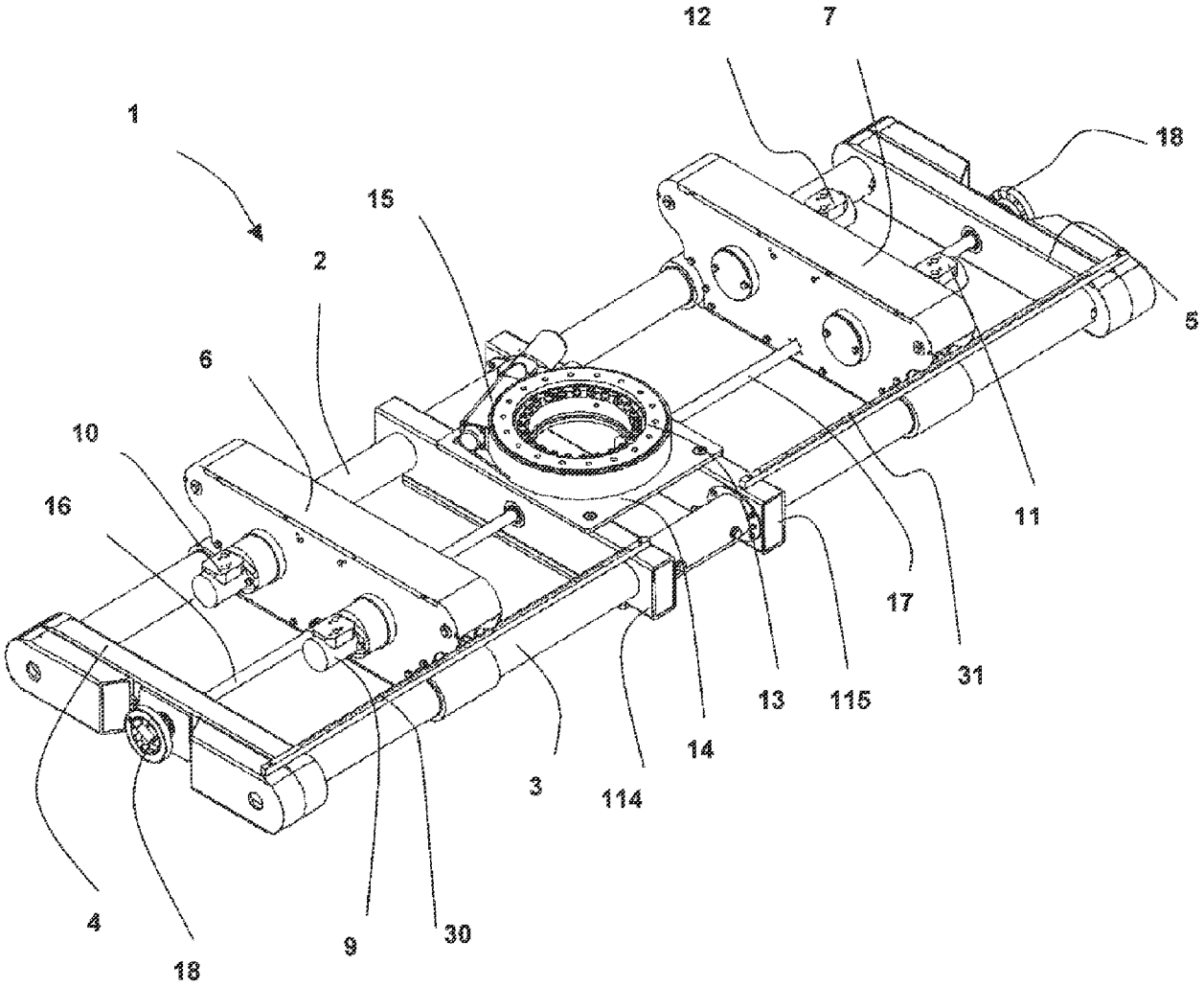
FIG. 1 shows a diagram of a gripping mechanism according to an embodiment of the invention.

The following reference numbers may be used in conjunction with the drawings.

1 frame
2 longitudinal beam
3 longitudinal beam
4 cross member
5 cross member
6 carriage
7 carriage
8 rewind device
9 motor
10 motor
11 motor
12 motor
13 rotation plate
14 central plate
15 drive
16 spindle
17 spindle
18 handwheel
19 belt
20 belt
21 tubes
101 gripping mechanism
102 longitudinal beam
103 longitudinal beam
104 cross member
105 cross member
106 holding device
107 holding device
108 drive shaft
109 drive shaft
110 Traverse
111 rotating device
112 holding device
113 holding device
114 cross support
115 cross support
116 spindle nut
118 spindle
120 rewind device
201 gripping mechanism
202 longitudinal beam
203 longitudinal beam
204 cross member
205 cross member
207 holding device
208 holding device
209 drive shaft
210 holding device
211 holding device
214 drive shaft
215 rewind device
216 spindle
217 spindle nut
218 traverse
219 connection

DETAILED DESCRIPTION OF ILLUSTRATIVE EMBODIMENTS

FIGS. 1 to 4 show an embodiment of the invention. A frame 1, which comprises two parallel longitudinal beams 2 and 3 and two cross beams 4 and 5 which are fixed at the ends of the longitudinal beams 2 and 3.

Adjustable carriages 6 and 7 are arranged along the longitudinal beams 2 and 3. Each carriage 6, 7 has two rewind devices 8 spaced apart from each other and individually drivable by motors 9, 10, 11 and 12.

Between the carriages 6 and 7, a rotating device 13 such as a rotation plate 13 is mounted on a central plate 14 which is fixed to two cross supports 114, 115 which in turn are connected to the frame 1. The rotation device 13 is drivable by a drive 15.

The carriage 6 is driven by a spindle 16 which engages in a non-visible manner by a worm or an endless screw to the carriage 6 itself. The slide 7 is driven by a spindle 17 and engaged by a worm or an endless screw in the same way. Each spindle 16, 17 is engaged with a worm and an endless screw with the slide itself. Each spindle 16, 17 can be adjusted or actuated by a handwheel 18.

Figure 2:
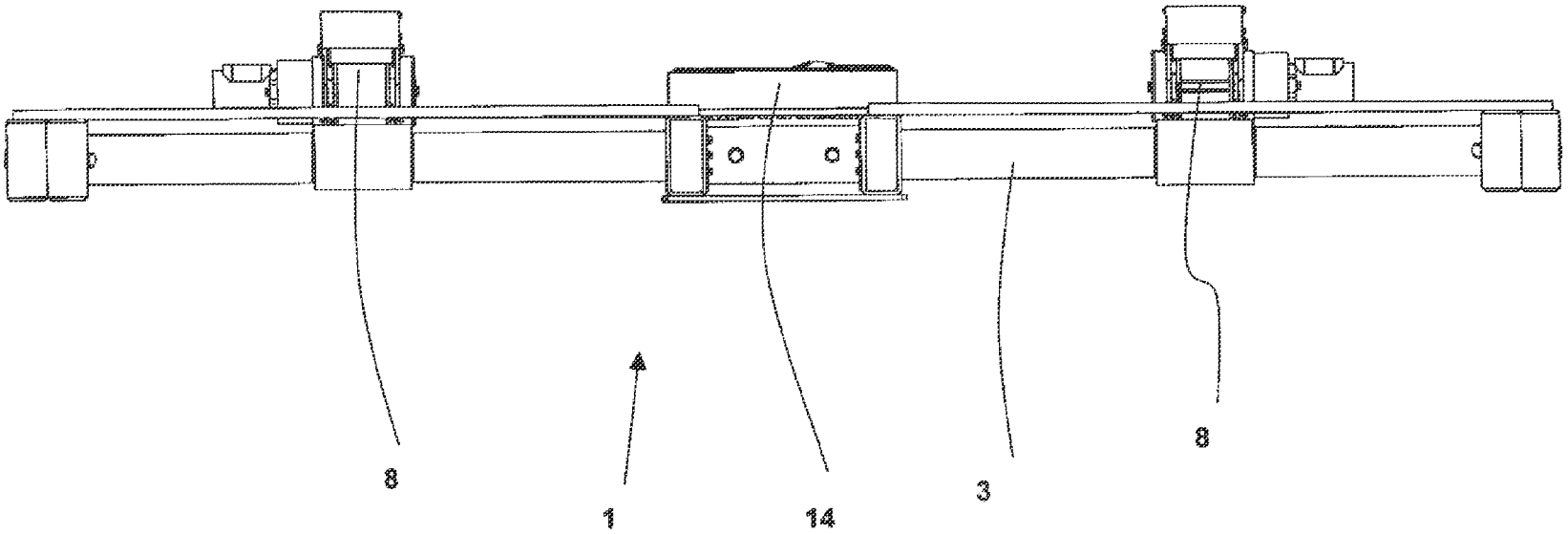
FIG. 2 shows a side view of the same mechanism.
Figure 3:
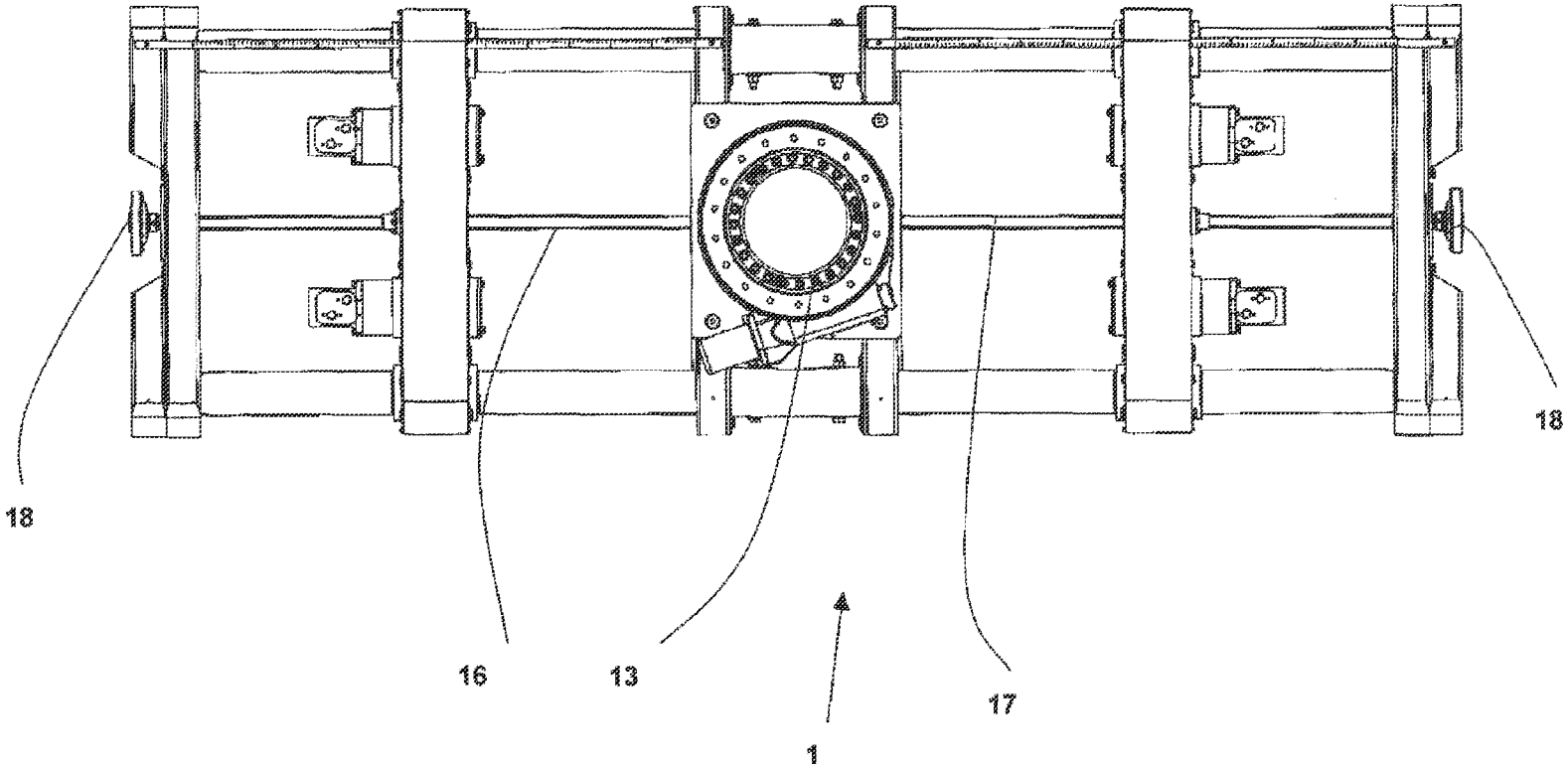
FIG. 3 shows a plan view.
Figure 4:
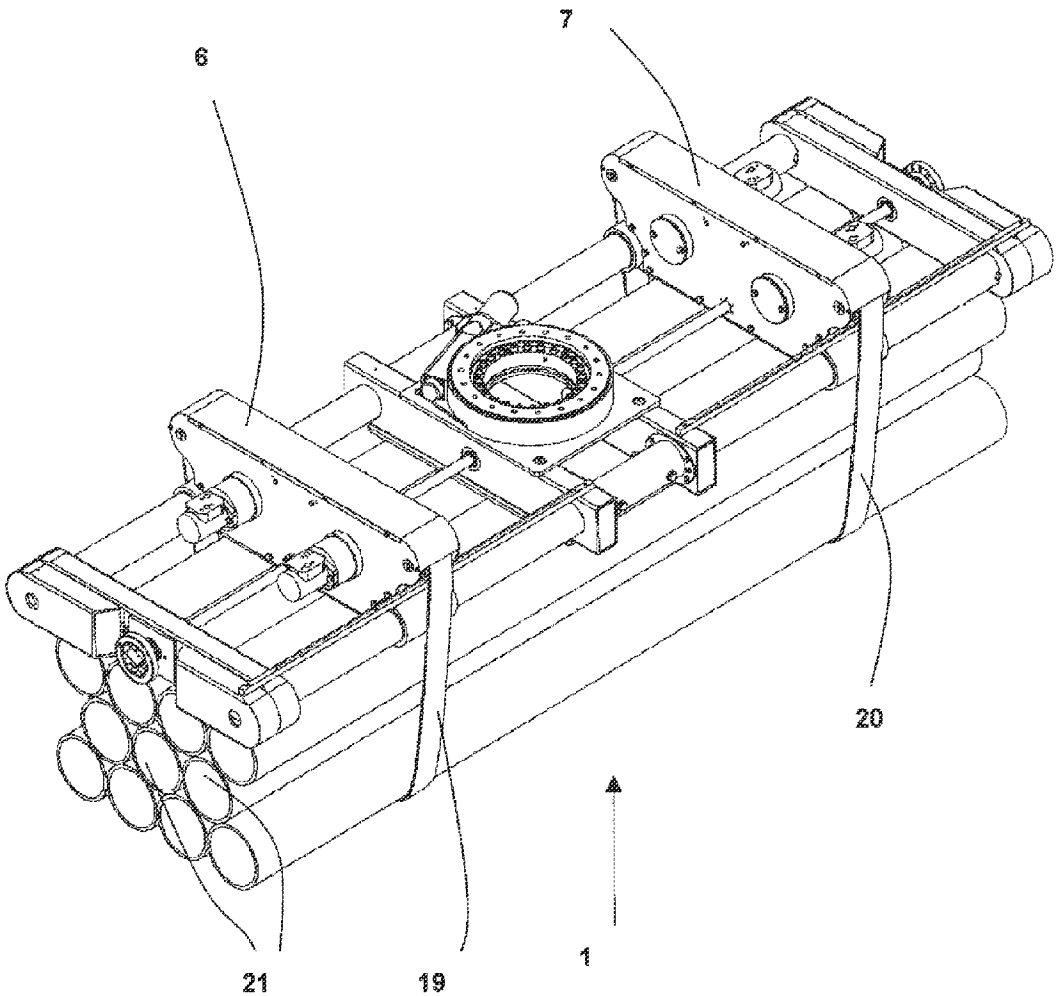
FIG. 4 shows a diagram of a poignant package to be delivered pipe gripping mechanism.
Figure 5:
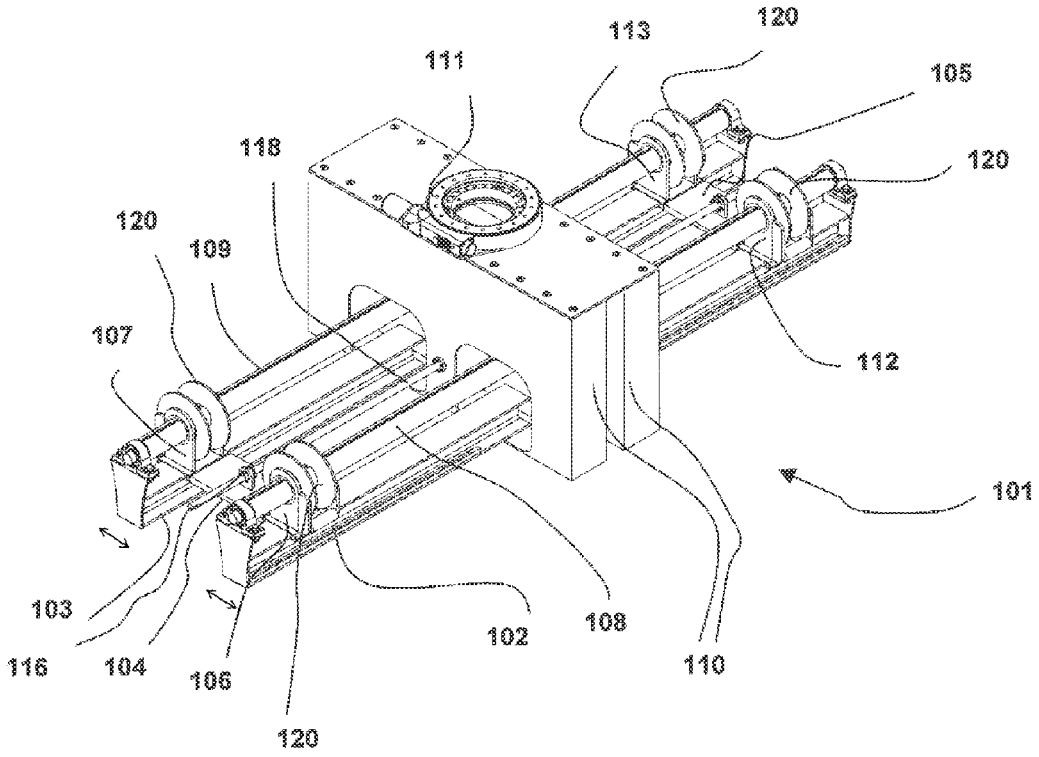
FIG. 5 shows a diagram of a further embodiment of the gripping mechanism according to the invention.
Figure 6:
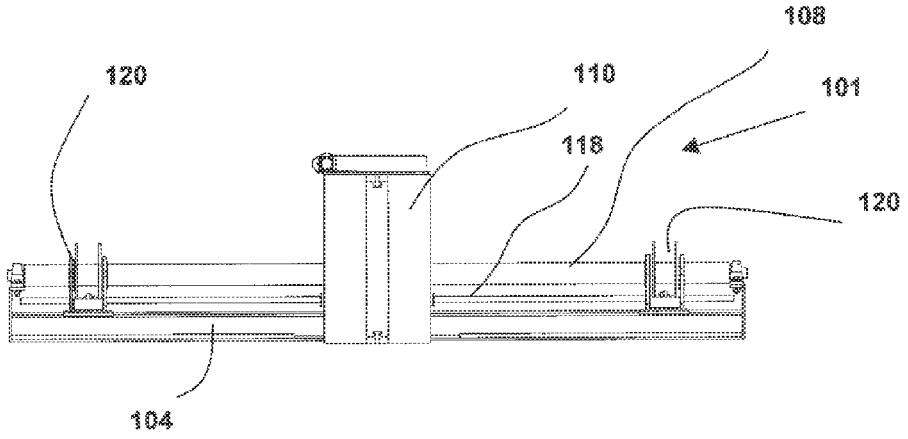
FIG. 6 shows a side view of FIG. 5.
Figure 7:
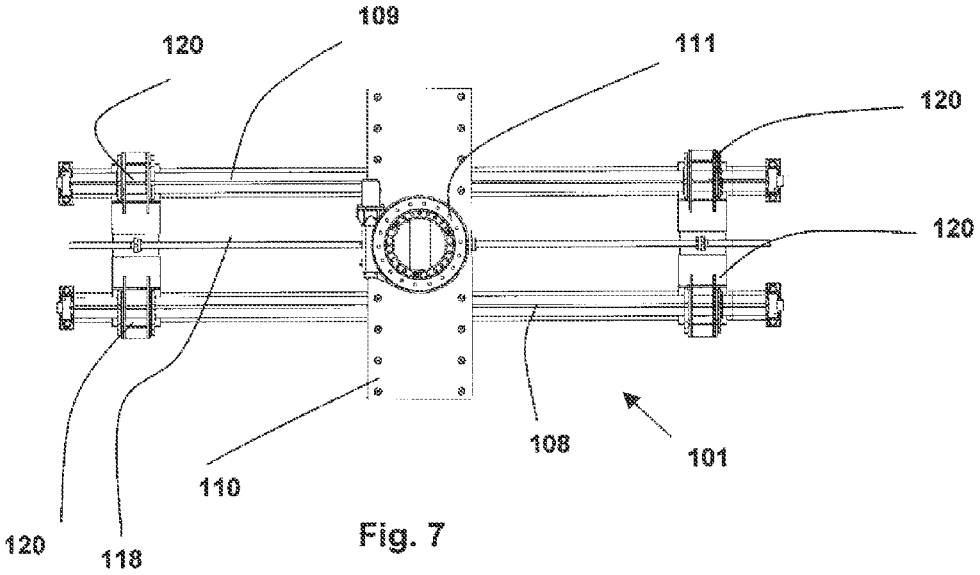
FIG. 7 shows a top view of FIG. 5.
Figure 8:
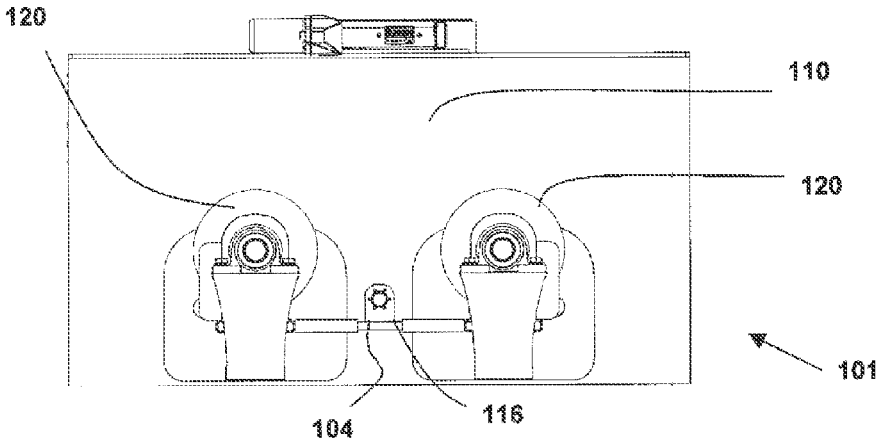
FIG. 8 shows an back view of FIG. 5.
Figure 9:
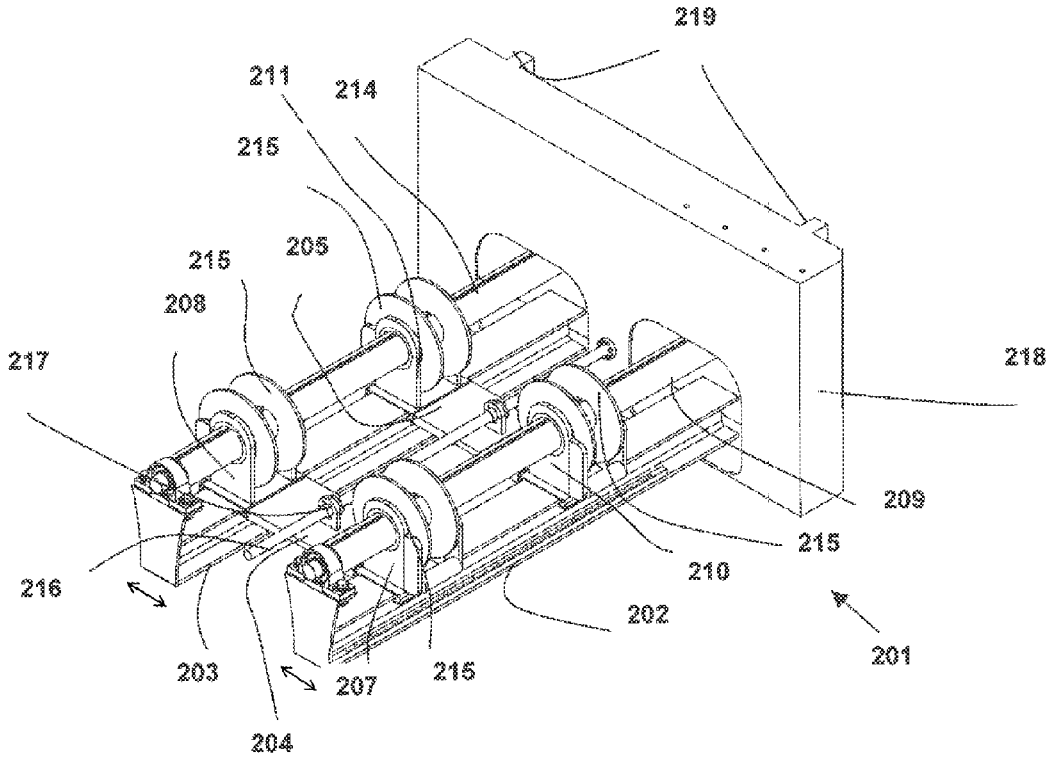
FIG. 9 is a diagram of another embodiment of a gripping mechanism according to the invention.
Figure 10:
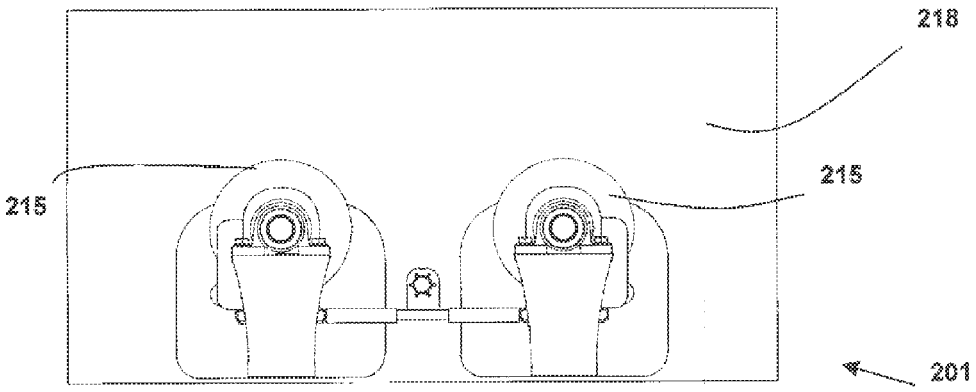
FIG. 10 is an end view of FIG. 9.
Figure 11:
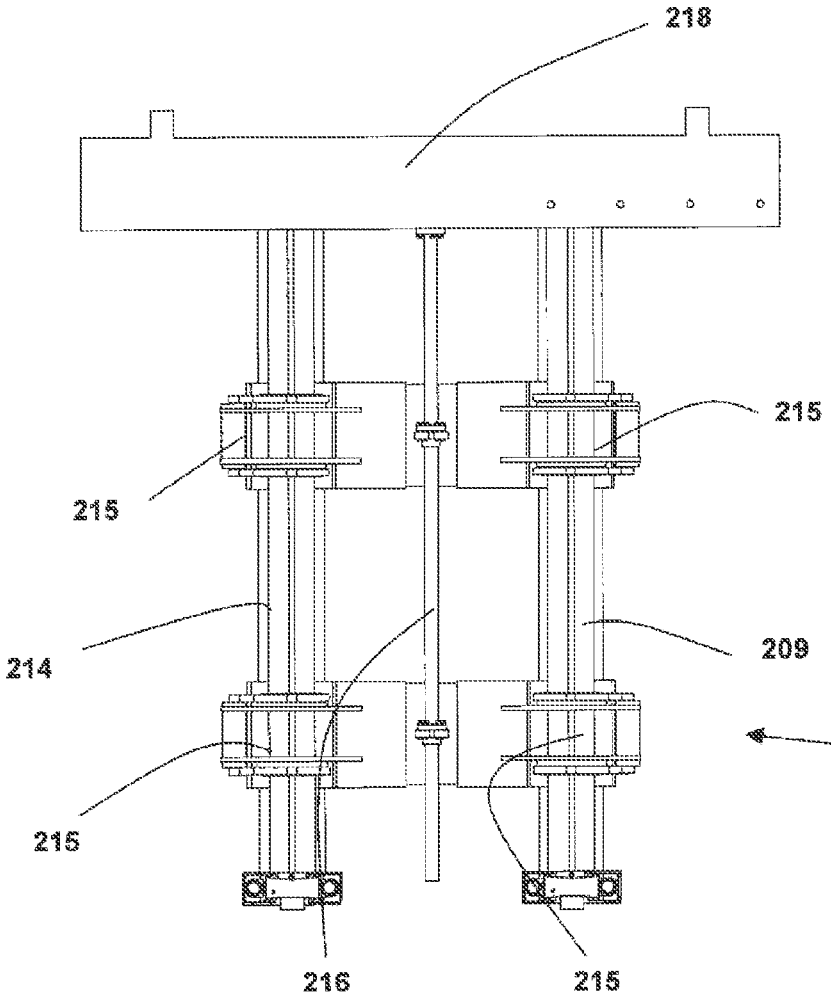
FIG. 11 shows a top view of FIG. 9.
Figure 12:
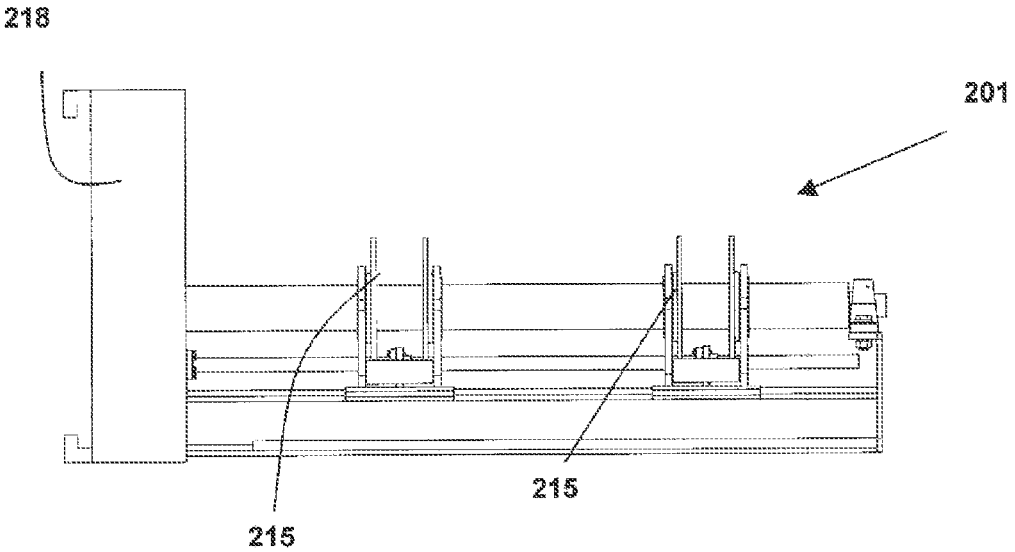
FIG. 12 shows a side view of FIG. 9.

As shown in FIGS. 2 and 4, the rewind devices 8 can lengthen or shorten, unwind and recoil the belt 19 of the carriage 6 and the belt 20 of the carriage 7 via respective motors. The corresponding motors 9, 10, 11 and 12 operate the rewind devices 8. When the belts 19 and 20 are recoiled the load can be pressed against the lower surface of the frame 1. The load may be tubes 21.

Advantageously, a scale bar 30 is arranged on one of the longitudinal supports 2, 3, between the cross member 4 and the cross support 114 and a scale bar 31 is arranged between the cross member 5 and the cross support 115 in order to determine the position of at least one of the carriage 6 and the carriage 7 relative to the center of the frame 1.

Conveniently, the frame surface of the frame 1 facing the cargo or product to be transported may be covered with a friction coating to prevent slippage of the product or load.

FIGS. 5 to 8 show a gripping mechanism 101 according to another embodiment of the invention.

The gripping mechanism 101 comprises two longitudinal members 102 and 103 on which cross members 104 and 105 are slidably adjustable. Each slidable cross member 104, 105 is extendable or retractable by adjusting the two longitudinal members 102 and 103 in a transversal direction (not described in detail herein). Each cross member 104, 105 is extendable or contractible by adjusting the longitudinal beams 102 and 103 relative to each other.

Each slidable cross member 104, 105 comprises holding devices 106 and 107 mounted in a region of each longitudinal member 104, 105. Drive shafts 108 and 109 are mounted to the holding device 106, 107. A traverse 110 drives or turns each drive shaft 108, 109. A drive moving the drive shafts 108, 109 is not shown. The traverse 110 comprises a rotating device 111. The rotating device 111 is configured to be connected to a hoist or lifting gear. The hoist or lifting gear may be a crane arm.

Symmetrical to the spindle 118 the drive shafts 108 and 109 extend the holding devices 112 and 113 which rotate on the longitudinal members 102 and 103. The slidable cross members 104 and 105 are movable along the longitudinal beams 102 and 103. Rewind devices 120 are mounted on the drive shafts 108, 109 at the holders 106, 107, 112 and 113.

The cross members 104 and 105 are driven by a spindle 118. The spindle 118 is engaged in a screw nut 116, each screw nut 116 is secured to the slidable cross members 104 and 105.

FIGS. 9 to 12 show embodiments of gripping mechanisms configured to be attached to a forklift.

In further embodiments, a gripping mechanism 201 is provided with longitudinal beams 202 and 203. Similar to the other embodiments, the cross members 204 and 205 are slidably mounted on the longitudinal beams 202 and 203. However, in deviation from the embodiment described above, both cross-members 204 and 205 are driven by drive shafts 209, 214 which are arranged in holding devices 207 and 208 or 210 and 211, and which are driven by a drive in the traverse 218. Each drive shaft 209, 214 arranges a rewind device 215.

Each cross member 204, 205 is driven by a spindle 216 which engages in a spindle nut 217 at the cross members 204, 205.

Numerous other embodiments are provided without departing from the scope of the present invention.

Other types of drives moving the cross members can be provided instead of the drive spindle.

Embodiments of the invention also relate to methods for transporting cargo with the gripping mechanism. The method comprises the following steps;

a) positioning the rewind devices on the cross members along the longitudinal members for adjusting the spacing of the continuous flexible elements from each other depending on the length of the cargo and/or positioning of the rewind devices transverse to the longitudinal members for adjusting the spacing of the longitudinal members from each other in dependence of the circumference of the cargo;

b) grasping the cargo by the continuous flexible elements (19, 20);

c) pressing of the cargo on the support surface of the gripping mechanism by shortening the continuous flexible elements (19,20) using the rewind devices;

d) orienting and moving the cargo; and e) unloading the cargo.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A gripping mechanism comprising:

a frame comprising parallel longitudinal members and cross members;

a connecting device supported by the frame, the connecting device configured to receive a lifting gear;

carriages connected to the longitudinal members, the carriages configured to be adjustable along the longitudinal members, wherein the carriages are adjustable by a drive;

rewinding devices located at the carriages; and continuous flexible elements configured to receive a product to be transported, wherein ends of the continuous flexible elements are connected to the rewinding devices, and wherein the rewinding devices are configured to lengthen or shorten the continuous flexible elements.

2. The gripping mechanism according to claim 1, further comprising motors, wherein a motor is configured to drive a rewinding device.

3. The gripping mechanism according to claim 1, wherein the drive is configured to drive a spindle, and wherein the spindle moves the carriages.

4. The gripping mechanism according to claim 1, further comprising cross bars, wherein the connecting device is located at the cross members.

5. The gripping mechanism according to claim 1, wherein the connecting device comprises a rotating plate configured to be operated by a motor.

6. The gripping mechanism according to claim 1, wherein the connecting device is configured to be tiltable.

7. The gripping mechanism according to claim 1, wherein the carriages are adjustable via a spindle, and wherein the carriages are connected to the spindle via a spindle nut.

8. The gripping mechanism according to claim 1, wherein the continuous flexible elements comprise belts, chains, ropes or bands.

9. The gripping mechanism according to claim 1, wherein a surface of the frame is covered with a friction material.

10. A method for lifting a product to be transported applying a gripping mechanism according to claim 1, the method comprising:

positioning the rewinding devices on the cross members along the longitudinal members thereby adjusting a spacing of the continuous flexible elements relative to each other, unwinding the continuous flexible elements;

grasping the product to be transported with the continuous flexible elements;

pressing of the product to be transported on a support surface of the frame by shortening the continuous flexible elements using the rewinding devices;

moving the product to be transported; and unloading the product to be transported.

11. A gripping mechanism comprising:

parallel longitudinal members;

slidable cross members, wherein the slidable cross members are adjustable by a drive;

a traverse holding the parallel longitudinal members and comprising a rotating device, the rotating device configured to receive a lifting gear;

drive shafts connecting the traverse to rewind devices, wherein the rewind devices are arranged in holding devices on the slidable cross members, and wherein the drive shafts are configured to drive the rewind devices; and continuous flexible elements, wherein a continuous flexible element is connected with its ends to the rewind devices, and wherein the continuous flexible elements are configured to receive a product to be transported.

12. The gripping mechanism according to claim 11, further comprising a spindle configured to adjust the slidable cross members along the longitudinal members.

13. The gripping mechanism according to claim 12, wherein the spindle is engaged in a screw nut and wherein the screw nut is secured to slideable cross members.

14. The gripping mechanism according to claim 11, wherein the parallel longitudinal members are adjustable relative to each other.

15. The gripping mechanism according to claim 11, wherein the slidable cross members are located on opposite sides of the traverse.

16. A gripping mechanism comprising:

parallel longitudinal members;

slidable cross members, wherein the slidable cross members are adjustable by a drive;

a traverse holding the parallel longitudinal members;

drive shafts connecting the traverse to rewind devices, wherein the rewind devices are arranged in holders on the slidable cross members, and wherein the drive shafts are configured to drive the rewind devices; and continuous flexible elements, wherein a continuous flexible element is connected with its ends to the rewind devices, and wherein the continuous flexible elements are configured to receive a product to be transported.

17. The gripping mechanism according to claim 16, further comprising a spindle, the spindle configured to adjust the slidable cross members along the longitudinal members.

18. The gripping mechanism according to claim 17, wherein the spindle is engaged in a screw nut and wherein the screw nut is secured to slideable cross members.

19. The gripping mechanism according to claim 16, wherein the parallel longitudinal members are adjustable relative to each other.

20. The gripping mechanism according to claim 16, wherein the slidable cross members are located on the same side of the traverse.

* * * * *